US006619592B2

(12) United States Patent
Vignaroli et al.

(10) Patent No.: US 6,619,592 B2
(45) Date of Patent: Sep. 16, 2003

(54) SELF-ACTUATING FIREARM

(75) Inventors: Marco Vignaroli, Perugia (IT); Sergio Scaramucci, Gallo di Petriano (IT); Maurizio Boccarossa, Fossombrone (IT)

(73) Assignee: Benelli Armi S.p.A., Urbino (IT)

( * ) Notice: Subject to any disclaimer, the term of this patent is extended or adjusted under 35 U.S.C. 154(b) by 0 days.

(21) Appl. No.: 09/995,115

(22) Filed: Nov. 27, 2001

(65) Prior Publication Data

US 2002/0073832 A1 Jun. 20, 2002

(30) Foreign Application Priority Data

Dec. 14, 2000 (IT) ..... MI2000A2700

(51) Int. Cl.[7] ..... F41A 5/18
(52) U.S. Cl. ..... 244/191.01; 244/192; 244/193
(58) Field of Search ..... 89/191.01, 192, 89/193; 42/14, 16, 39.5

(56) References Cited

U.S. PATENT DOCUMENTS 2,149,512 A 3/1939 Eiane ..... 42/3
2,582,989 A * 1/1952 Harvey ..... 89/193
3,657,960 A 4/1972 Badali ..... 89/191
3,779,131 A 12/1973 Kawamura ..... 89/191 A
4,409,883 A * 10/1983 Nyst ..... 89/192
6,382,073 B1 * 5/2002 Beretta ..... 89/193

FOREIGN PATENT DOCUMENTS

EP 0 789 217 A1 8/1997

* cited by examiner

*Primary Examiner*—J. Woodrow Eldred
(74) *Attorney, Agent, or Firm*—R. Neil Sudol; Henry D. Coleman; William J. Sapone

(57) ABSTRACT

A self-actuating firearm comprising a frame, a breechblock, a barrel provided with a bore, a cylinder which is associated with the barrel and forms an internal chamber which is connected to the bore of the barrel, by means of a gas tap, and a piston which is at least partially accommodated in the chamber and can be actuated by the gases that arrive from the bore upon firing. The piston floats with respect to the cylinder and the frame and comprises a portion which is external to the cylinder and is adapted to act with an impulsive action on the breechblock in order to recock the firearm upon firing.

20 Claims, 5 Drawing Sheets

SELF-ACTUATING FIREARM

BACKGROUND OF THE INVENTION

1. Field of the Invention

The present invention relates to a self-actuating firearm, particularly a gas-operated automatic or semiautomatic firearm.

2. Description of the Prior Art

In gas-operated automatic or semiautomatic firearms, a portion of the gas produced by firing moves a piston, by passing from the bore or mouth into an expansion chamber and the piston acts on the loading and firing mechanism.

When the breechblock is pushed backward by the stem of the piston, the breechblock body moves away from the head and performs its backward stroke, compressing the recoil spring, the case is extracted and expelled and the firing pin is cocked.

Many gas operating systems have been proposed as part of the continuous quest for reliability and precision in operation, constructive simplicity, and versatility in use.

The aim of the present invention is to provide a self-actuating firearm of the gas-operated type, which is improved with respect to the firearms of the prior art.

An object of the invention is to provide a gas-operated self-actuating firearm which is constructively simple and particularly reliable.

An important object of the invention is to provide a gas-operated self-actuating firearm which can be easily disassembled in order to perform ordinary maintenance of the firearm.

Another object of the invention is to provide a gas-operated self-actuating firearm wherein the gas collection device is not easily clogged by the residues that are present in the gas.

SUMMARY OF THE INVENTION

This aim and these and other objects that will become better apparent to those skilled in the art, are achieved by a self-actuating firearm as claimed in the appended claims.

BRIEF DESCRIPTION OF THE DRAWINGS

Further characteristics and advantages of the invention will become better apparent from a reading of the detailed description of a preferred but not exclusive embodiment of a firearm according to the invention, illustrated only by way of a non-limiting example in the accompanying drawings, wherein.

DESCRIPTION OF THE PREFERRED EMBODIMENTS OF THE INVENTION

Figure 1:
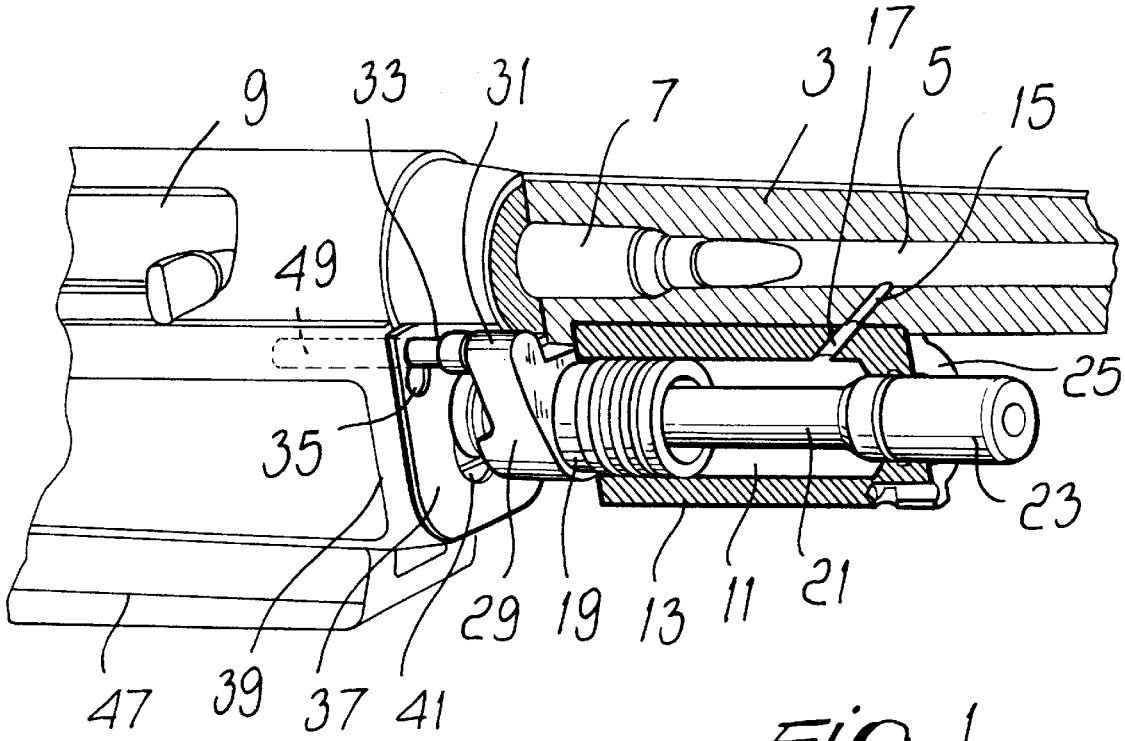
FIG. 1 is a partially sectional perspective view of a gas-operated self-actuating firearm according to the invention.
Figure 4:
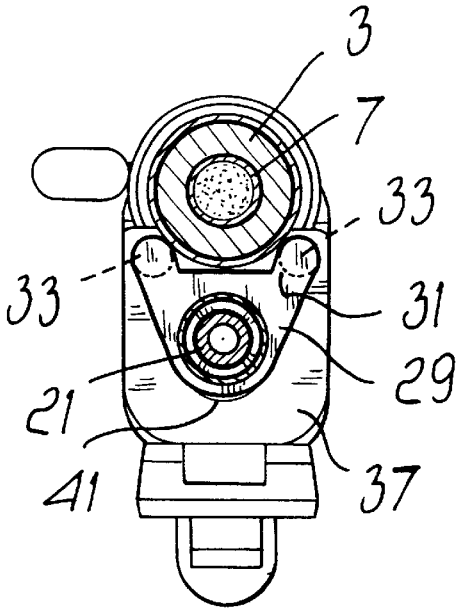
FIG. 4 is a partial front elevation sectional view, taken along the transverse line IV—IV of FIG. 2, of the firearm of the preceding figures.
Figure 2:
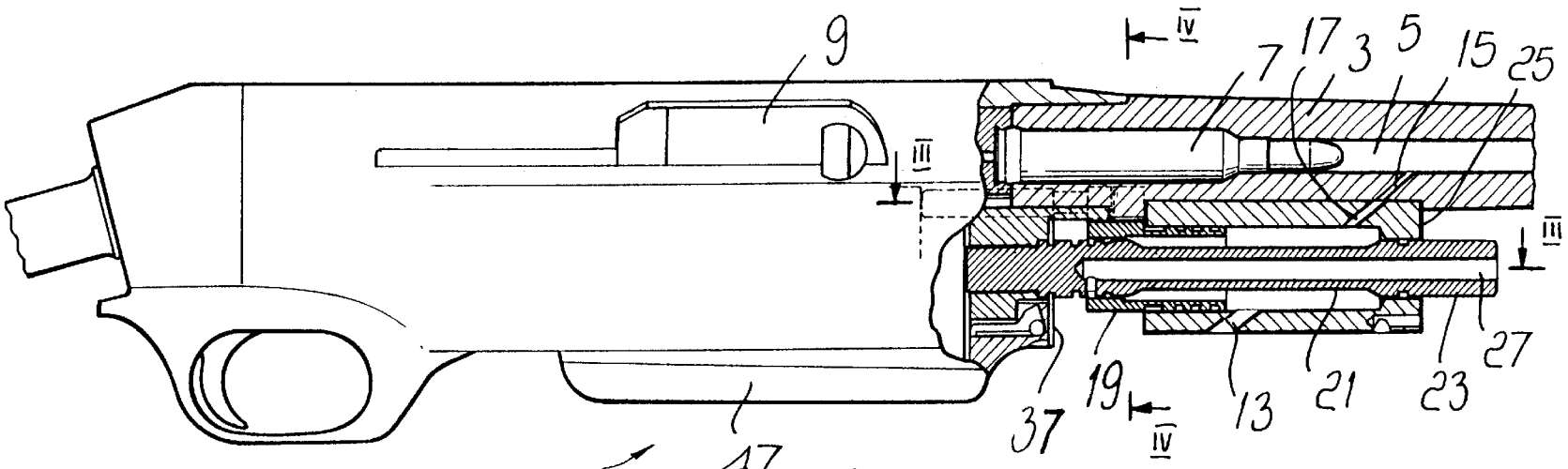
FIG. 2 is a partial sectional side view, taken along a longitudinal plane, of the firearm of FIG. 1.
Figure 3:
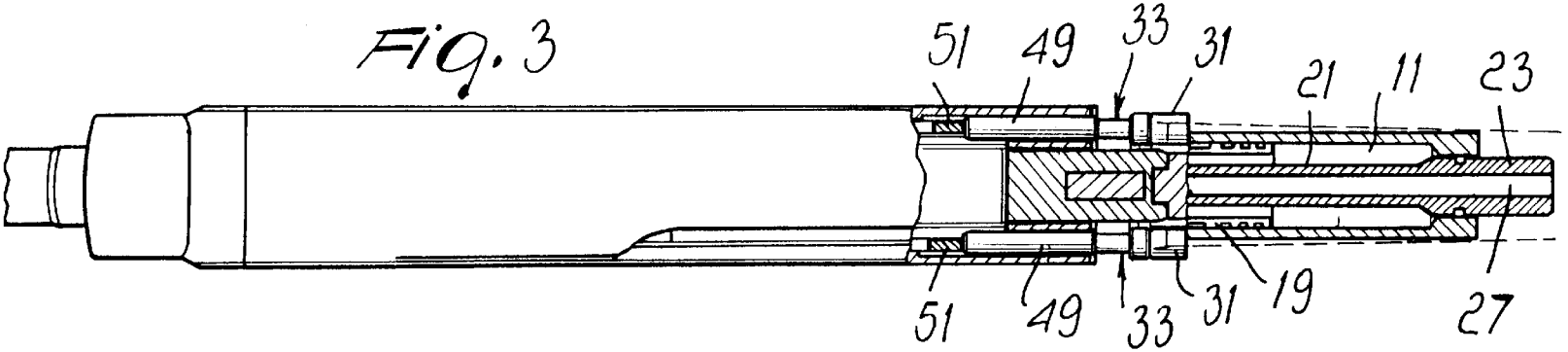
FIG. 3 is a partial sectional view, taken along the line III—III of FIG. 2, of the firearm of the preceding figures.

FIGS. 1–6 illustrate, as an example of embodiment of the automatic or semiautomatic firearm, according to the invention, a rifle, generally designated by the reference numeral 1, comprising a barrel 3 having a bore 5 connected to a firing chamber that accommodates a cartridge 7 and that can be closed by a breechblock 9, in a per se known manner.

The breechblock is actuated by a kinematic system which receives energy from the firing gases that arrive from a gas tap 15, provided in the barrel 3 and connecting the bore 5 of the barrel to an internal chamber 11 of a cylinder 13 which is associated with the barrel 3 and is in turn provided with a passage 17, for the gas.

The cylinder 13 comprises a piston 19 that can slide on a post 21 which is coaxial to the chamber 11 and has a cylindrical block 23, at the opposite end with respect to the piston 19. The cylindrical block 23 protrudes at least partially from a front end 25 of the cylinder 13.

The post 21 is crossed by an axial passage 27 which is open onto the front part of the block 23 and ends with a radial passage 53 at a wider base 55 of the post 21.

Figure 6:
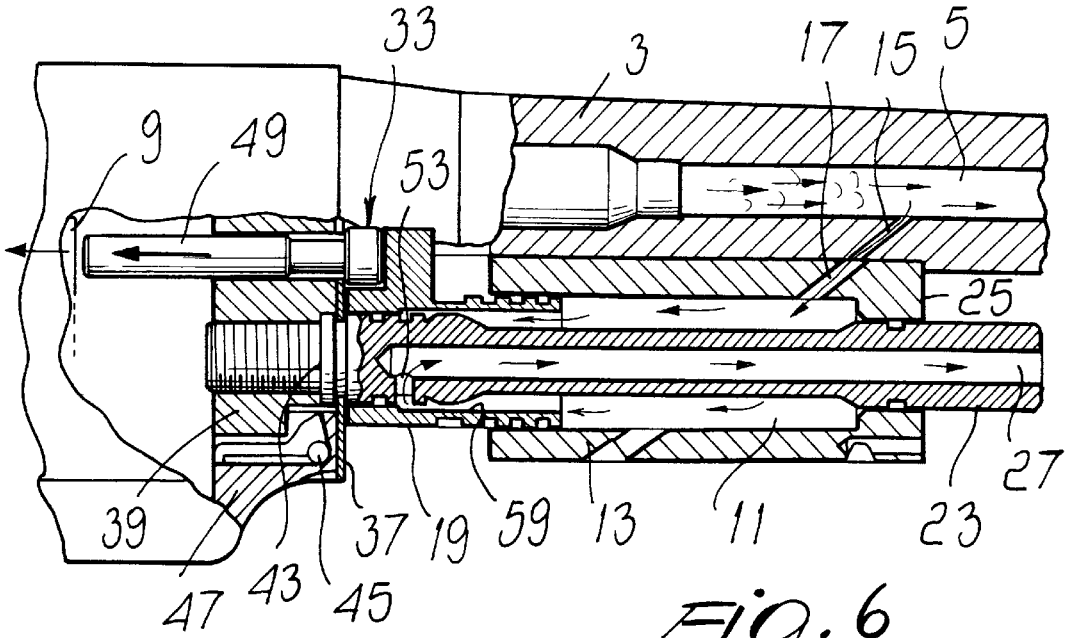
FIG. 6 is a partial view, similar to FIG. 2 but in enlarged scale, of the device immediately after firing.
Figure 7:
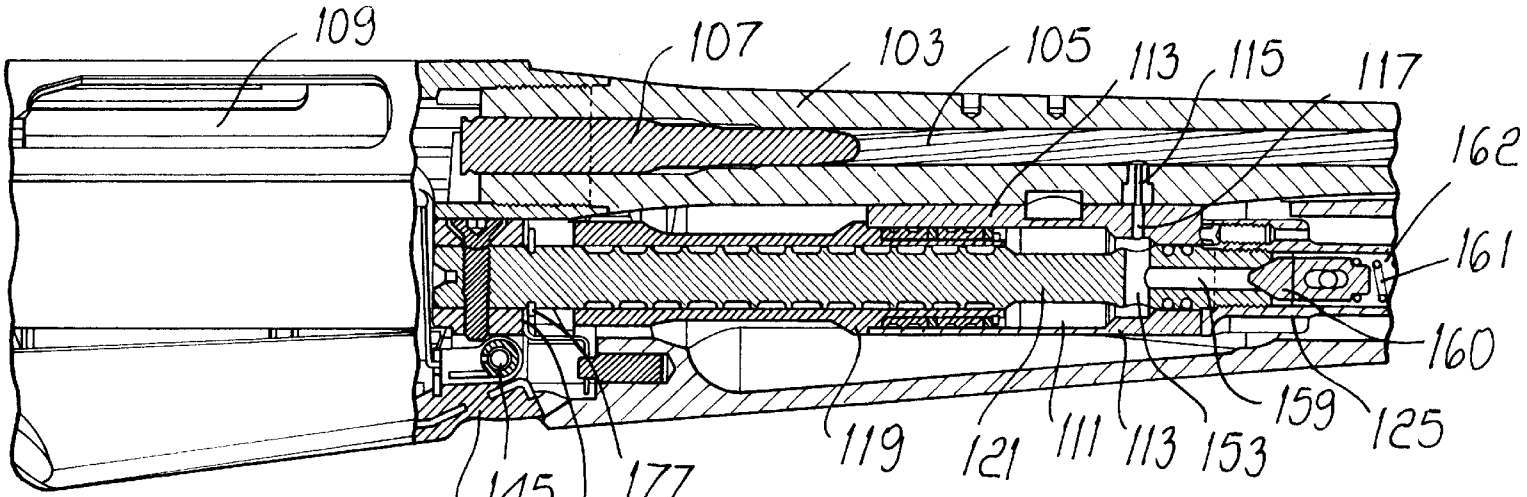
FIG. 7 is a longitudinally sectioned, partial side view, of a gas-operated self-actuating firearm according to a further aspect of the invention.
Figure 8:
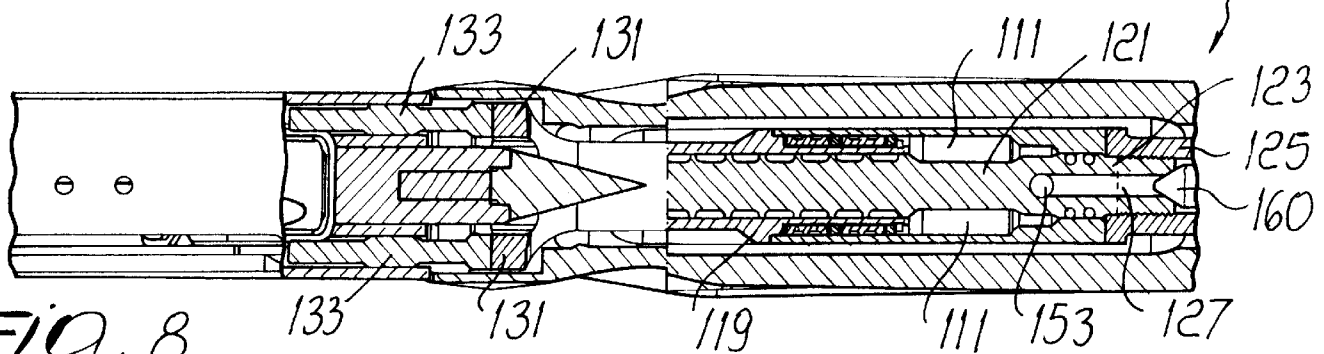
FIG. 8 is a top plan, longitudinally sectioned, view of the firearm of FIG. 7.
Figure 9:
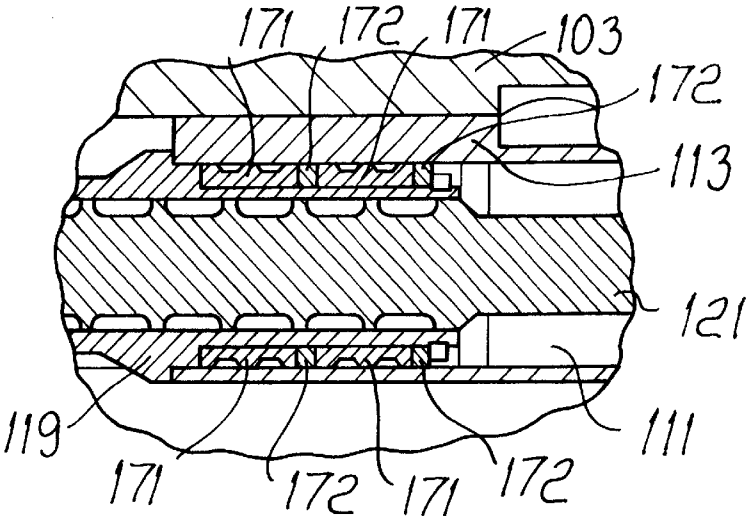
FIG. 9 is an enlarged side, longitudinally sectioned, view of a detail of the cylinder of the firearm of FIGS. 7 and 8.
Figure 10:
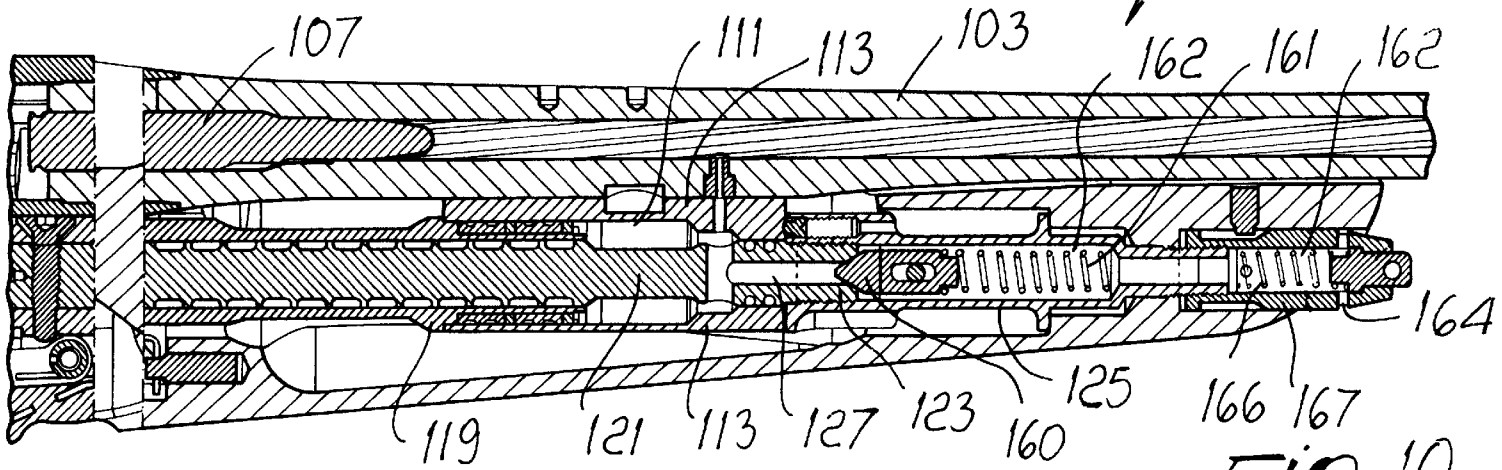
FIG. 10 is a longitudinally sectioned side view of the front part of the firearm of FIGS. 7–9.

The piston 19 has a first inside diameter 57, so that it can slide hermetically with respect to the wider base 55 of the post 21, and has a second inside diameter 59, which is greater than the first diameter, so that in a stroke limit position, shown in FIG. 6, the radial passage 53 is open onto the internal chamber 11 of the cylinder 13.

A flat member 29 is rigidly associated with the piston 19, externally to the cylinder 13, and comprises two protrusions 31 adapted to act on respective pins 33 that are kinematically connected to the kinematic actuation system of the breechblock 9.

The pins 33 protrude from respective lateral slots 35 formed in a plate 37 which closes a frame 39 of the firearm at the front.

The plate 37 has a central slot 41, crossed by a base 43 of the post 21, which can be screwed into the frame 39.

The slots 35 and 41 allow to disassemble the plate 37 that can be lifted and extracted from the pins 33 and from the post 21.

The plate 37 is also provided with interlocking means for locking it on the frame 39.

The plate 37 is also adapted to lock a hinge assembly 45 of a magazine 47 which is associated with the frame 39.

Each of the pins 33 has a stem 49 which is internal to the frame 39 and can slide in a respective guide 51 formed therein. The end of the stem 49 is adapted to make contact with a surface of the breechblock 9.

The operation of the firearm according to the invention is as follows.

Figure 5:
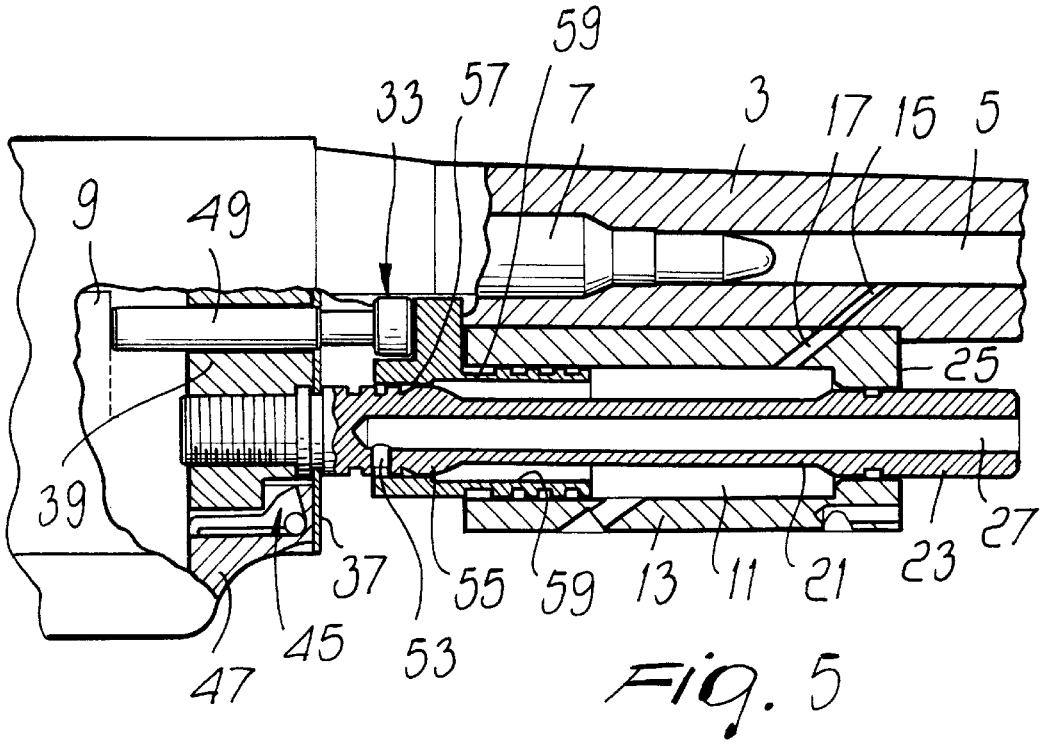
FIG. 5 is a partial view, similar to FIG. 2 but in enlarged scale, of the device in the position in which it is ready for firing.

Initially, before firing, the piston 19 is in an inactive position, shown in FIG. 5, in which the radial passage 53 is closed by the first inside diameter 57 of the piston 19.

Upon firing, a fraction of the gases, generated by firing, passes into the chamber 11 of the cylinder 13, through the gas intake 15 and the passage 17, and pushes the piston 19, which in turn acts, by means of the flat member 29 and the protrusions 31, on the pins 33, that act on the breechblock 9, causing its retraction, as shown in FIG. 6.

When the piston reaches the end of its stroke, which is determined by the abutment of the flat member 29 against the plate 37, the radial passage 53 is located at the second inside diameter 59 of the piston 19, and since the second inside diameter 59 is greater than the first inside diameter 57, it therefore connects the chamber 11 of the cylinder 13 to the axial passage 27 of the post 21, thus discharging the gases externally.

In the meantime, the kinematic system of the breechblock, by the action of the recocking spring, pushes the breechblock into the closure position and also pushes the piston 19, by means of the pins 33, into an inactive position, ready for subsequent firing.

The system for discharging the excess gases through the axial passage 27 is particularly advantageous, and keeps the component parts of the gas collection device clean, considerably reducing interventions for cleaning and maintenance.

Another important characteristic of the firearm, according to the invention, is that the sleeve, or cylinder, 13 of the gas collection device is rigidly associated with the barrel, allowing to disassemble the barrel by sliding the lining off the post 21, which can remain associated with the frame 39.

In such manner, the barrel can be disassembled rapidly and easily for ordinary cleaning and maintenance and also allows to maintain unchanged the setting of the sights.

Another advantage of the invention, from the manufacturing point of view, is that it is possible to adapt the gas collection chamber 11 to the caliber of the firearm during manufacture simply by replacing the post 21, keeping unchanged all the other component parts of the gas collection device. The volume of the chamber 11 can in fact be adjusted simply by varying the diameter of the post 21.

Another interesting feature, according to an aspect of the invention, is the plate 37, which performs several tasks. First of all, it prevents the piston from directly striking the frame 39, which is generally made of aluminum alloy and is therefore more susceptible to damage. According to a first aspect of the invention, a second function of the plate 37 is to retain the magazine when the firearm has a pivoting magazine, of the kind shown in the figures of the present embodiment. The plate 37 also retains the pins 33, preventing their loss when the barrel is disassembled. Once the barrel has been disassembled, the piston 19 can in fact be slid off the post 21.

According to a first aspect of the invention, the plate can be easily disassembled and reassembled, with a sliding motion, being interlocked with the frame 39 and having slots 35 and 41, appropriately widened in order to allow the passage of the pins 33 and of the wider portions 23 and 55 of the post 21.

Once the plate has been disassembled, the pins 33 can be extracted from their respective seats in the frame 39 and also the post 21 can be unscrewed and removed from the frame.

FIGS. 7–10 illustrate a further embodiment of the invention constituted by a rifle, generally designated by the reference numeral 101, comprising a barrel 103 having a bore 105 connected to a firing chamber that accommodates a cartridge 107 and that can be closed by a breechblock 109, in a per se known manner.

The breechblock 109 is actuated by a kinematic system which receives energy from the firing gases that arrive from a gas tap 115, provided in the barrel 103 and connecting the bore 105 of the barrel to an internal chamber 111 of a cylinder 113 which is associated with the barrel 103 and is in turn provided with a passage 117, for the gas.

The cylinder 113 comprises a piston 119 that can slide on a post 121 which is coaxial to the chamber 111 and has a cylindrical block 123, at the opposite end with respect to the piston 119. The cylindrical block 123 protrudes, at least partially, from the front end of the cylinder 113 and extends into a front cylinder or cap 125.

An axial passage 127 extends longitudinally in the post 121 and is open on the front part of the cylindrical block 123 while, on the opposite side, ends into a radial passage 153 which connects the axial passage 127 with chamber 111.

Post 121 also has a front passage 159, connected with radial passage 153, and connecting chamber 111 with the outside, through a safety valve comprising a conical pin 160 and a bias spring 161, both arranged in a discharge chamber 162 which is substantially inside front cylinder 125.

Discharge chamber 162 extends inside a fastening cap 167 screwed on the front cylinder 125 with the interposition of a contrast spring 166 which is substantially arranged inside the front portion of the discharge chamber 162.

Discharge chamber 162 is open to the outside through a radial vent 164 formed in fastening cap 167.

A seal means is provided between piston 119 and the inner surface of cylinder 113 in order to improve the sliding of piston 119 inside the cylinder.

The seal means comprises external seal rings 171 and internal seal rings 172.

The term "external" seal rings 171, in this case, identifies the rings that provide a seal on the cylinder surface while having a play with respect to the piston. The term "internal" seal rings 172 identifies rings that provide a seal with respect of the piston surface while having a play with respect to the cylinder.

In such manner, the production of the seal means is simplified, because the tolerances are greatly simplified, and also the seal means are self-entering when assembling the parts.

Piston 119 is associated with a pair of protrusions 131 adapted to act on the breechblock 109 of the firearm in a manner similar to the above described first embodiment.

The operation of the firearm illustrated in FIGS. 7–10 is substantially similar to that of the above described first embodiment.

A different feature of this second embodiment, with respect of the first embodiment, is that a plate, designated by the reference numeral 137 in this second embodiment, is provided in a position similar to that of the plate 37 of the first embodiment. However, plate 137 is not provided with slots for its disassembly and does not have the function of retaining the hinge assembly 145 of the magazine as in the first embodiment.

Plate 137 has, however, the function of guiding the post on the front hole and is mounted by means of a snap ring 177.

In practice it has been observed that the invention achieves the intended aim and objects, a gas collection device for automatic or semiautomatic firearms having been provided which is particularly efficient and constructively simple.

The device, according to the invention, is susceptible of numerous modifications and variations, within the scope of the appended claims, and all the details may be replaced with technically equivalent elements.

The materials used, as well as the dimensions, may of course be any according to requirements and to the state of the art.

What is claimed is:

1. A self-actuating firearm comprising:

a frame;

a breechblock;

a barrel provided with a bore;

a cylinder associated with said barrel and forming an internal chamber which is connected to the bore of the barrel by means of a gas tap; and a piston which is at least partially accommodated in said chamber and can be actuated by gases that arrive from said bore upon firing of the firearm, said piston floating with respect to said cylinder and said frame and being integral with a recocking element which is external to said cylinder and is adapted to act with an impulsive action on said breechblock In order to recock the firearm upon firing, a seal means being provided between said piston and an Inner surface of said cylinder in order to improve the sliding of said piston inside said cylinder, said seal means comprising external seal rings and internal seal rings, wherein said external seal rings provide a seal on the cylinder surface while having a play with respect to the piston, said internal seal rings providing a seal with respect to an outer piston surface while having a play with respect to the cylinder, in order to simplify the production of said seal means and in order to provide a self centering assembly of respective parts of the firearm.

2. The self-actuating firearm according to claim 1, further comprising a floating means which floats with respect to said frame and is arranged between said recocking element and said breechblock; said floating means comprising two pins, each of said pins comprising a stem slidably inserted in a respective guide formed in said frame, a free end of the stem being adapted to make contact with a surface of the breechblock.

3. The self-actuating firearm according to claim 2, further comprising a post rigidly coupled to said frame and extending along an entire length of said cylinder inside said chamber, said piston being slidingly mounted on said post, a seal being provided between said post and an inner surface of said cylinder, said chamber being formed by the inner surface of said cylinder and by an outer surface of said post.

4. The self-actuating firearm according to claim 3 wherein an axial passage is formed in said post and is open outward at a front end of said post, said axial passage being alternately connected to said chamber in order to vent excess gases that are generated by firing and fed to said chamber.

5. The self-actuating firearm according to claim 4 wherein said post has a wider base at a rear end, said post being coaxial with the chamber, said post comprising a cylindrical block at an end opposite the piston, said cylindrical block protruding at least partially from a front end of the cylinder; said axial passage of said post being open at a front part of the block and being provided, at a rear end, with a radial passage formed in the wider base of said post.

6. The self-actuating firearm according to claim 5 wherein said piston has a first inner diameter sized so that said is in slidable hermetic engagement with respect to the wider base of the post, said piston having a second inner diameter larger than said first inner diameter so that, in a stroke limit position, the radial passage in the wider base of said post communicates with the internal chamber of the cylinder.

7. The self-actuating firearm according to claim 3 wherein said floating means takes the form of two pins, said recocking element comprising a flat member disposed externally to the cylinder, said flat member including two protrusions adapted to act on said pins.

8. The self-actuating firearm according to claim 7, further comprising a plate closing the frame of the firearm at a front side thereof, said plate being formed with slots from which said pins protrude, said plate also including a central slot traversed by the base of said post, said slots allowing a disassembly of the plate wherein the plate is lifted and slid off the pins and the post, said plate being also provided with interlocking means for removably locking the plate to the frame.

9. The self-actuating firearm according to claim 8, further comprising a pivoting magazine coupled with said frame by means of a hinge assembly, said plate being adapted to retain said hinge assembly of said magazine.

10. The self-actuating firearm according to claim 3 wherein said post comprises a cylindrical block at an end opposite said piston, said cylindrical block protruding at least partially from a front end of the cylinder and extending into a front cylinder or cap.

11. The self-actuating firearm according to claim 10 wherein an axial passage extends longitudinally in said post and is open at a front part of said cylindrical block, said axial passage being provided on an opposite side with a radial passage which connects the axial passage with said chamber.

12. The self-actuating firearm according to claim 11 wherein said post has a front passage connected with said radial passage and connecting said chamber with the outside through a safety valve.

13. The self-actuating firearm according to claim 12 wherein said safety valve comprises a conical pin and a bias spring, both arranged in a discharge chamber which is substantially inside said front cylinder or cap.

14. The self-actuating firearm according to claim 13 wherein said discharge chamber extends inside a fastening cap, screwed on said front cylinder or cap, with the interposition of a contrast spring which is substantially arranged inside a front portion of said discharge chamber, said discharge chamber being open to the outside through a radial vent formed in said fastening cap.

15. The self-actuating firearm according to claim 3, further comprising a plate adapted to guide said post through a front hole in said frame, a snap ring being provided for mounting said plate.

16. A self-actuating firearm comprising:

a frame;

a breechblock;

a barrel provided with a bore;

a cylinder associated with said barrel and forming an internal chamber which is connected to the bore of the barrel by means of a gas tap;

a piston which is at least partially accommodated in said chamber and can be actuated by gases that arrive from said bore upon firing of the firearm; and a pair of floating pins each comprising a stem slidably inserted in a respective guide formed in said frame, a free end of the stem being adapted to make contact with a surface of the breechblock, said piston floating with respect to said cylinder and said frame and being integral with a recocking element which is external to said cylinder and is adapted to act with an impulsive action on said pins In order to recock the firearm upon firing, said pins being located between said recocking element and said breechblock.

17. A self-actuating firearm comprising:

a frame;

a breechblock;

a barrel provided with a bore;

a cylinder associated with said barrel and forming an internal chamber which is connected to the bore of the barrel by means of a gas tap;

a piston which is at least partially accommodated in said chamber and can be actuated by gases that arrive from said bore upon firing of the firearm;

a post rigidly coupled to said frame and extending along an entire length of said cylinder inside said chamber, said piston being slidingly mounted on said post, said post comprising a cylindrical block at an end opposite said piston, said cylindrical block protruding at least partially from a front end of the cylinder and extending into a front cylinder or cap; and a safety valve arranged in a discharge chamber which is substantially inside said front cylinder or cap, said discharge chamber extends inside a fastening cap, screwed on said front cylinder or cap, with the interposition of a contrast spring which is substantially arranged inside a front portion of said discharge chamber.

18. The firearm according to claim 17 wherein said discharge chamber is open to the outside through a radial vent formed in said fastening cap.

19. The firearm according to claim 17 wherein a seal is provided between said post and an inner surface of said cylinder, said chamber being formed by the inner surface of said cylinder and by an outer surface of said post.

20. The firearm according to claim 17 wherein an axial passage extends longitudinally in said post and is open at a front part of said cylindrical block, said axial passage being provided on an opposite end with a radial passage which connects the axial passage with said chamber.

* * * * *